US005664868A

United States Patent [19]

Montalbano et al.

[11] Patent Number: 5,664,868

[45] Date of Patent: Sep. 9, 1997

[54] HELMET RIGID FLASHLIGHT BRACKET

[76] Inventors: David Montalbano, 78 Commack Rd., North Babylon, N.Y. 11703; Michael Goldman, 152 Periwinkle Rd., Levitown, N.Y. 11756

[21] Appl. No.: 654,212

[22] Filed: May 28, 1996

[51] Int. Cl.[6] ..... F21L 15/14

[52] U.S. Cl. ..... 362/105; 362/106; 362/396; 362/191; 248/229.15

[58] Field of Search ..... 362/105, 106, 362/396, 103, 288, 287, 427, 32, 191; 248/229.15; 24/3.9

[56] References Cited

U.S. PATENT DOCUMENTS

| | | | |
|---|---|---|---|
| D. 353,221 | 12/1994 | Scott et al. | D26/138 |
| 1,318,850 | 10/1919 | De Yong | 362/396 |
| 2,524,173 | 10/1950 | Peterson | 362/396 |
| 4,298,913 | 11/1981 | Lozar | 362/105 |
| 4,521,831 | 6/1985 | Thayer | 362/105 |
| 4,998,187 | 3/1991 | Herrick | 362/103 |
| 5,163,752 | 11/1992 | Copeland et al. | 362/32 |
| 5,438,494 | 8/1995 | Harlan | 362/105 |

OTHER PUBLICATIONS

Advertisement by Wehr Engineering, 8192 W. 700 N. Fairland, IN 46126.

*Primary Examiner*—James C. Yeung
*Attorney, Agent, or Firm*—Richard L. Miller, P.E.

[57] ABSTRACT

A helmet rigid flashlight bracket that is replaceably and securingly attachable to a portion of a brim of a helmet that is wearable by a user and replaceably and securingly receives a flashlight of a variety of different flashlights each of which has a handle portion and a light emitting portion that emits a light beam that points substantially at eye level in a forward direction of the user that includes a face plate, flashlight maintaining apparatus, a substantially C-shaped channel, and face plate clamping apparatus. The face plate has a lower portion. The flashlight maintaining apparatus is disposed on the face plate and replaceably and securingly maintains the handle portion of the flashlight of the variety of different flashlights to the face plate. The substantially C-shaped channel is disposed on the lower portion of the face plate in an orientation so as to be parallel to the light beam that emits from the light emitting portion of the flashlight of the variety of different flashlights. And, the face plate clamping apparatus is associated with the substantially C-shaped channel and replaceably and securingly clamps the face plate to the portion of the brim of the helmet, so that the light beam that emits from the light emitting portion of the flashlight of the variety of different flashlights points substantially at eye level in the forward direction of the user.

21 Claims, 2 Drawing Sheets

FIG. 7
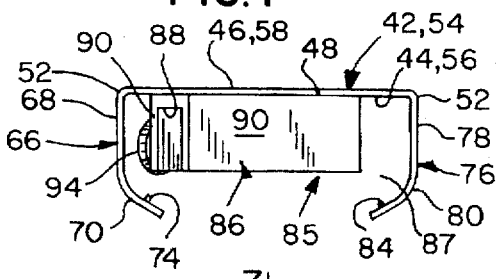
FIG. 6
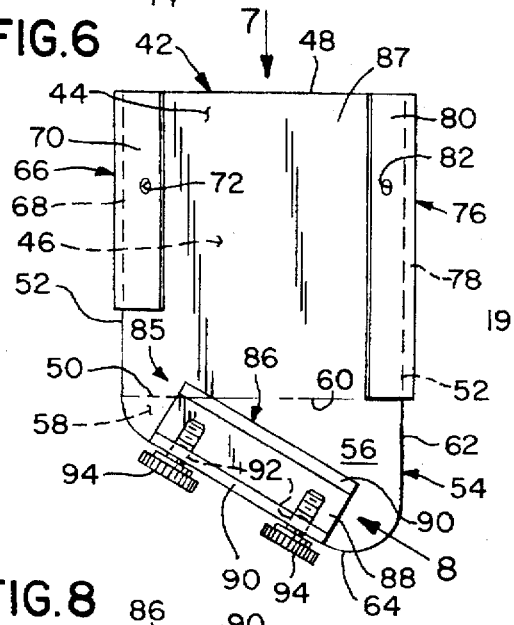
FIG. 8
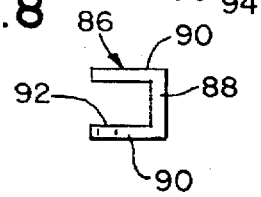
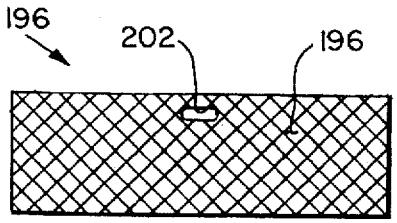
FIG. 12
FIG. 10
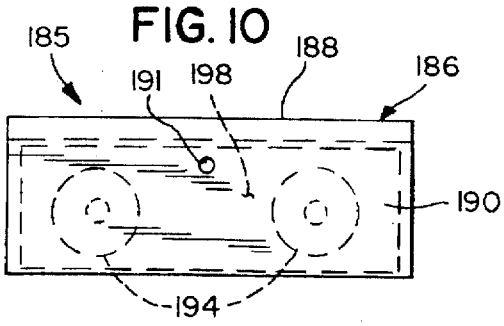
FIG. 9
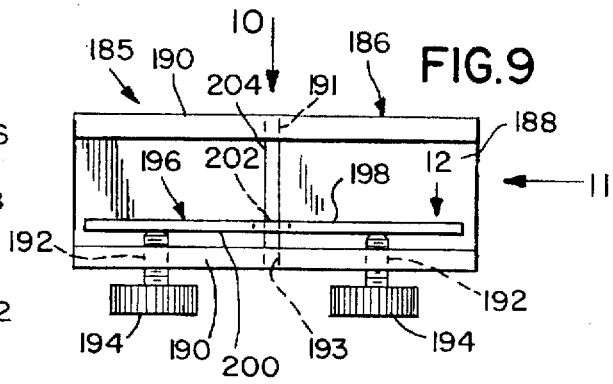
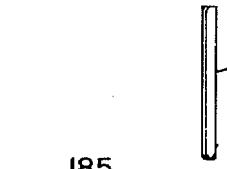
FIG. 11
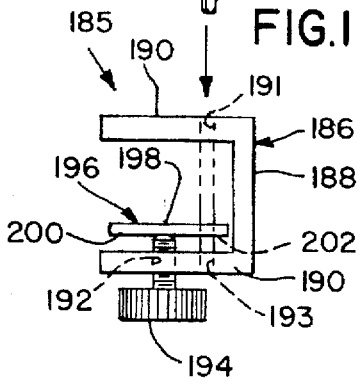

HELMET RIGID FLASHLIGHT BRACKET

BACKGROUND OF THE INVENTION

The present invention relates to a head gear light bracket. More particularly, the present invention relates to a helmet rigid flashlight bracket that is replaceably and securingly attachable to a portion of a brim of a helmet that is wearable by a user and replaceably and securingly receives a flashlight of a variety of different flashlights each of which has a handle portion and a light emitting portion that emits a light beam that points substantially at eye level in a forward direction of the user that includes a face plate, flashlight maintaining apparatus, a substantially C-shaped channel, and face plate clamping apparatus.

Lights have long been attached centrally to a front portion of mining helmets and other types of hard hats used for construction, maintenance, and other working conditions. Firefighter helmets and most other hats and caps, however, require discretionary attachment of lighter and more adjustable lights. Heat resistance and minute weight of special small lights with high lighting capacity are particularly significant to firefighters for placement on their helmets.

Numerous innovations for head gear light holders have been provided in the prior art that will be described. Even though these innovations may be suitable for the specific individual purposes to which they address, however, they differ from the present invention in that they do not teach a helmet rigid flashlight bracket that is replaceably and securingly attachable to a portion of a brim of a helmet that is wearable by a user and replaceably and securingly receives a flashlight of a variety of different flashlights each of which has a handle portion and a light emitting portion that emits a light beam that points substantially at eye level in a forward direction of the user that includes a face plate, flashlight maintaining apparatus, a substantially C-shaped channel, and face plate clamping apparatus.

FOR EXAMPLE, U.S. Pat. No. Des. 353,221 to Scott et al. teaches an ornamental design for a flashlight clip of a helmet that is pivotally mounted to the side of the crown of a helmet using existing face shield holes and/or a rubber strap.

ANOTHER EXAMPLE, U.S. Pat. No. 4,998,187 to Herrick teaches a headlight holder that includes an outer generally convex shape that has a base member with an upper surface and a lower surface. The lower surface has a generally concave curvature so as to conform to at least a portion of the convex outer surface of the users helmet. An upper member has a pair of opposing support members that extend outwardly and upwardly in a lateral direction to the base member.

STILL ANOTHER EXAMPLE, U.S. Pat. No. 5,438,494 to Harlan teaches a head gear light that includes a leaf-spring strap that is sized and shaped cylindrically to be wrapped circumferentially around a cylindrical outside periphery of a flashlight body. Opposite circumferential ends of the leaf-spring strap are extended perpendicularly to an axis of a cylindrical shape of the leaf-spring strap at circumferential positions between which a gap that has a select width is provided for drawing the opposite circumferential ends of the leaf-spring strap together in the gap to tighten a cylindrical inside periphery of the leaf-spring strap against an outside periphery of the flashlight body in a grasping relationship.

FINALLY, YET ANOTHER EXAMPLE, is disclosed in a advertisement by Wehr Engineering, 8192 W. 700 N., Fairland, 46126 U.S.A., 800-457-4527, 317-835-7824, FAX 317-835-2992, as a HELMET LIGHT HOLSTER (TM) that is pivotally mounted to the side of the crown of a helmet using existing face shield holes and/or a rubber strap.

It is apparent that numerous innovations for head gear light holders have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a helmet rigid flashlight bracket that avoids the disadvantages of the prior art.

ANOTHER OBJECT of the present invention is to provide a helmet rigid flashlight bracket that is simple and inexpensive to manufacture.

STILL ANOTHER OBJECT of the present invention is to provide a helmet rigid flashlight bracket that is simple to use.

YET ANOTHER OBJECT of the present invention is to provide a helmet rigid flashlight bracket that is specifically designed to mount a LIFELITE(TM) style flashlight to the side brim of a firefighter helmet wherein LIFELITE(TM) is a trademark of Garrity Industries, Stamford Ct., U.S.A.

STILL YET ANOTHER OBJECT of the present invention is to provide a helmet rigid flashlight bracket that it mounts onto a fire-fighter helmet is seconds without additional hardware, tooling, or modification to the fire-fighter helmet.

YET ANOTHER OBJECT of the present invention is to provide a helmet rigid flashlight bracket that allows easy access to the ON/OFF switch of the LIFELITE(TM).

STILL YET ANOTHER OBJECT of the present invention is to provide a helmet rigid flashlight bracket that can be replaceably mounted to either or both the right and left sides of the rim of the helmet.

BRIEFLY STATED, YET STILL ANOTHER OBJECT of the present invention is to provide a helmet rigid flashlight bracket that is replaceably and securingly attachable to a portion of a brim of a helmet that is wearable by a user and replaceably and securingly receives a flashlight of a variety of different flashlights each of which has a handle portion and a light emitting portion that emits a light beam that points substantially at eye level in a forward direction of the user that includes a face plate, flashlight maintaining apparatus, a substantially C-shaped channel, and face plate clamping apparatus.

STILL YET ANOTHER OBJECT of the present invention is to provide a helmet rigid flashlight bracket wherein the face plate has a lower portion.

YET STILL ANOTHER OBJECT of the present invention is to provide a helmet rigid flashlight bracket wherein the flashlight maintaining apparatus is disposed on the face plate and replaceably and securingly maintains the handle portion of the flashlight of the variety of different flashlights to the face plate.

STILL YET ANOTHER OBJECT of the present invention is to provide a helmet rigid flashlight bracket wherein the substantially C-shaped channel is disposed on the lower portion of the face plate in an orientation so as to be parallel to the light beam that emits from the light emitting portion of the flashlight of the variety of different flashlights.

YET STILL ANOTHER OBJECT of the present invention is to provide a helmet rigid flashlight bracket wherein the face plate clamping apparatus is associated with the substantially C-shaped channel and replaceably and securingly clamps the face plate to the portion of the brim of the helmet, so that the light beam that emits from the light emitting portion of the flashlight of the variety of different flashlights points substantially at eye level in the forward direction of the user.

STILL YET ANOTHER OBJECT of the present invention is to provide a helmet rigid flashlight bracket wherein the helmet rigid flashlight bracket is made from aluminum, so that when worn by a fire-fighter the helmet rigid flashlight bracket will not corrode and will not be damaged by water and smoke and pollutants generated by a fire.

YET STILL ANOTHER OBJECT of the present invention is to provide a helmet rigid flashlight bracket wherein the face plate has a flat and thin and generally rectangular-shaped upper portion with flat interior surface that has a longitudinal center, a flat exterior surface that is substantially parallel to the flat interior surface of the flat, thin and generally rectangular-shaped upper portion of the face plate, a straight top edge with ends, an imaginary bottom line that has ends and is disposed below, and substantially parallel to, the straight top edge of the flat, thin and generally rectangular-shaped upper portion of the face plate, and a pair of opposing, substantially parallel, and straight long sides that extend from the ends of the straight top edge of the flat, thin and generally rectangular-shaped upper portion of the face plate to the ends of the imaginary bottom line of the flat, thin and generally rectangular-shaped upper portion of the face plate.

STILL YET ANOTHER OBJECT of the present invention is to provide a helmet rigid flashlight bracket wherein the lower portion of the face plate is a flat, thin and generally 30–60 degree-right-triangular-shaped lower portion that is integral and co-planar with, and extends downwardly from, the flat, thin and generally rectangular-shaped upper portion of the face plate.

YET STILL ANOTHER OBJECT of the present invention is to provide a helmet rigid flashlight bracket wherein the flat, thin and generally 30–60 degree-right-triangular-shaped lower portion of the face plate has a flat interior surface that is continuous and co-planar with the flat interior surface of the flat, thin and generally rectangular-shaped upper portion of the face plate, a flat exterior surface that is substantially parallel to the flat interior surface of the flat, thin and generally 30–60 degree-right-triangular-shaped lower portion of the face plate and is continuous and co-planar with the flat exterior surface of the flat, thin and generally rectangular-shaped upper portion of the face plate, an imaginary long base line that is coincident and continuous and co-planar with the imaginary bottom line of the flat, thin and generally rectangular-shaped upper portion of the face plate, a short and straight rearwardmost edge that extends downwardly at a highermost end from, and is collinear with, a lowermost end of a rearwardmost side of the pair of opposing, substantially parallel, and straight long sides of the flat, thin and generally rectangular-shaped upper portion of the face plate, and a straight hypothenuse edge that extends downwardly and rearwardly at a forwardmost end, at an angle of approximately 30 degrees, from a lowermost end of a forwardmost side of the pair of opposing, substantially parallel, and straight long sides of the flat, thin and generally rectangular-shaped upper portion of the face plate to a lowermost end of the short and straight rearwardmost edge of the flat, thin and generally 30–60 degree-right-triangular-shaped lower portion.

STILL YET ANOTHER OBJECT of the present invention is to provide a helmet rigid flashlight bracket wherein a point of intersection between the forwardmost end of the straight hypothenuse edge of the flat, thin and generally 30–60 degree-right-triangular-shaped lower portion of the face plate and the lowermost end of the forwardmost side of the pair of opposing, substantially parallel, and straight long sides of the flat, thin and generally rectangular-shaped upper portion of the face plate and a point of intersection between the lowermost end of the short and straight rearmost side of the straight hypothenuse edge of the flat, thin and generally 30–60 degree-right-triangular-shaped lower portion of the face plate and the rearmost end of the straight hypothenuse edge of the flat, thin and generally 60 degree-right-triangular-shaped lower portion of the face plate are rounded for safety so as to avoid injury to the user.

YET STILL ANOTHER OBJECT of the present invention is to provide a helmet rigid flashlight bracket wherein the flashlight maintaining apparatus includes an elongated and substantially L-shaped forwardmost retainer that has an elongated and wide portion that is integral with, and is bent generally normally-outwardly from, the forwardmost side of the pair of opposing, substantially parallel, and straight long sides of the flat, thin and generally rectangular-shaped upper portion of the face plate, in a direction of the flat interior surface of the flat, thin and generally rectangular-shaped upper portion of the face plate, from a forwardmost end of the ends of the straight top edge of the flat, thin and generally rectangular-shaped upper portion of the face plate to a distance short of a forwardmost end of the ends of the imaginary bottom line of the flat, thin and generally rectangular-shaped upper portion of the face plate.

STILL YET ANOTHER OBJECT of the present invention is to provide a helmet rigid flashlight bracket wherein the elongated and substantially L-shaped forwardmost retainer further has an elongated, slightly arcuate-shaped, and narrow portion that has a substantial center and is bent generally normally and smoothly inwardly and slightly outwardly from the elongated wide portion of the elongated and substantially L-shaped forwardmost retainer towards the longitudinal center of the flat interior surface of the flat, thin and generally rectangular-shaped upper portion of the face plate.

YET STILL ANOTHER OBJECT of the present invention is to provide a helmet rigid flashlight bracket wherein the elongated, slightly arcuate-shaped, and narrow portion of the elongated and substantially L-shaped forwardmost retainer has a substantially centrally-disposed threaded throughbore that extends laterally through the substantial center of the elongated, slightly arcuate-shaped, and narrow portion of the elongated and substantially L-shaped forwardmost retainer.

STILL YET ANOTHER OBJECT of the present invention is to provide a hellnet rigid flashlight bracket wherein the elongated, slightly arcuate-shaped, and narrow portion of the elongated and substantially L-shaped forwardmost retainer further has a threaded set screw that threadably engages the substantially centrally-disposed threaded throughbore of the elongated, slightly arcuate-shaped, and narrow portion of the elongated and substantially L-shaped forwardmost retainer.

YET STILL ANOTHER OBJECT of the present invention is to provide a helmet rigid flashlight bracket wherein the flashlight maintaining apparatus further includes an elongated and substantially L-shaped rearwardmost retainer that has an elongated and wide portion that is substantially parallel to the elongated wide portion of the elongated and substantially L-shaped forwardmost retainer, and is integral with, and is bent generally normally-outwardly from a rearwardmost side of the pair of opposing, substantially parallel, and straight long sides of the flat, thin and generally rectangular-shaped upper portion of the face plate, in the direction of the flat interior surface of the flat, thin and generally rectangular-shaped upper portion of the face plate, from a rearwardmost end of the ends of the straight top edge of the flat, thin and generally rectangular-shaped upper portion of the face plate to a rearwardmost end of the ends of the imaginary bottom line of the flat, thin and generally rectangular-shaped upper portion of the face plate.

STILL YET ANOTHER OBJECT of the present invention is to provide a helmet rigid flashlight bracket wherein the elongated and substantially L-shaped forwardmost retainer, the elongated and substantially L-shaped rearwardmost retainer, and the flat interior surface of the flat, thin and generally rectangular-shaped upper portion of the face plate define a flashlight receptacle chamber that replaceably receives the handle portion of the flashlight of the variety of different flashlights therein.

YET STILL ANOTHER OBJECT of the present invention is to provide a helmet rigid flashlight bracket wherein the elongated and substantially L-shaped rearwardmost retainer further has an elongated, slightly arcuate-shaped, and narrow portion that has a substantial center and is substantially co-planar with the elongated, slightly arcuate-shaped, and narrow portion of the elongated and substantially L-shaped forwardmost retainer and is bent generally normally smoothly inwardly and slightly outwardly from the elongated wide portion of the elongated and substantially L-shaped rearwardmost retainer towards the longitudinal center of the flat interior surface of the flat, thin and generally rectangular-shaped upper portion of the face plate.

STILL YET ANOTHER OBJECT of the present invention is to provide a helmet rigid flashlight bracket wherein the elongated, slightly arcuate-shaped, and narrow portion of the elongated and substantially L-shaped rearwardmost retainer has a threaded throughbore that extends laterally therethrough in substantial alignment with the substantially centrally-disposed threaded throughbore of the elongated, slightly arcuate-shaped, and narrow portion of the elongated and substantially L-shaped forwardmost retainer.

YET STILL ANOTHER OBJECT of the present invention is to provide a helmet rigid flashlight bracket wherein the elongated, slightly arcuate-shaped, and narrow portion of the elongated and substantially L-shaped rearwardmost retainer further has a threaded set screw that threadably engages the threaded throughbore of the elongated, slightly arcuate-shaped, and narrow portion of the elongated and substantially L-shaped rearwardmost retainer.

STILL YET ANOTHER OBJECT of the present invention is to provide a helmet rigid flashlight bracket wherein the threaded set screw of the elongated, slightly arcuate-shaped, and narrow portion of the elongated and substantially L-shaped forwardmost retainer and the threaded set screw of the elongated, slightly arcuate-shaped, and narrow portion of the elongated and substantially L-shaped rearwardmost retainer replaceably and securingly maintain the handle portion of the flashlight of the variety of different flashlights in the flashlight receptacle chamber.

YET STILL ANOTHER OBJECT of the present invention is to provide a helmet rigid flashlight bracket wherein the face plate clamping apparatus includes the substantially C-shaped channel that has a base part with longitudinal sides and is spot welded to the flat interior surface of the flat, thin and generally 30–60 degree-right-triangular-shaped lower portion of the face plate along, and not overlaying, the straight hypothenuse edge of the flat, thin and generally 30–60 degree-right-triangular-shaped lower portion of the face plate, and a pair of opposing and substantially parallel longitudinal sides that extend normally-outwardly from the longitudinal sides of the basepart of the substantially C-shaped channel of the face plate clamping apparatus.

STILL YET ANOTHER OBJECT of the present invention is to provide a helmet rigid flashlight bracket wherein a lowermost side of the pair of opposing and substantially parallel longitudinal sides of the substantially C-shaped channel of the face plate clamping apparatus, which is in alignment with the straight hypothenuse edge of the flat, thin and generally 30–60 degree-right-triangular-shaped lower portion of the face plate, has a pair of spaced-apart, generally aligned, and threaded throughbores that pass laterally therethrough.

YET STILL ANOTHER OBJECT of the present invention is to provide a helmet rigid flashlight bracket wherein the face plate clamping apparatus further includes a pair of thumbscrews, each of which engages a respective throughbore of the pair of spaced-apart, generally aligned, and threaded throughbores of the lowermost side of the pair of opposing and substantially parallel sides of the substantially C-shaped channel of the face plate clamping apparatus, so that the substantially C-shaped channel of the face plate clamping apparatus replaceably receives the portion of the brim of the helmet while tightening of the pair of thumbscrews of the face plate clamping apparatus replaceably secures the helmet rigid flashlight bracket to the portion of the brim of the helmet and maintains the light beam emitting from the light emitting portion of the flashlight of the variety of different flashlights substantially at eye level in the forward direction of the user.

STILL YET ANOTHER OBJECT of the present invention is to provide a helmet rigid flashlight bracket wherein an uppermost side of the pair of opposing and substantially parallel longitudinal sides of the substantially C-shaped channel of the face plate clamping apparatus has a substantially circular-shaped throughbore that is disposed at a longitudinal center of the uppermost side of the pair of opposing and substantially parallel longitudinal sides of the substantially C-shaped channel of the face plate clamping apparatus, and in proximity to the base part of the substantially C-shaped channel of the face plate clamping apparatus.

YET STILL ANOTHER OBJECT of the present invention is to provide a helmet rigid flashlight bracket wherein the lowermost side of the pair of opposing and substantially parallel longitudinal sides of the substantially C-shaped channel of the face plate clamping apparatus further has a substantially circular-shaped throughbore that is disposed at a longitudinal center of the lowermost side of the pair of opposing and substantially parallel longitudinal sides of the substantially C-shaped channel of the face plate clamping apparatus, between the pair of spaced-apart, generally aligned, and threaded throughbores of the lowermost side of the pair of opposing and substantially parallel longitudinal sides of the substantially C-shaped channel of the face plate clamping apparatus and the base part of the substantially C-shaped channel of the face plate clamping apparatus, and in vertical alignment with the substantially circular-shaped throughbore of the uppermost side of the pair of opposing and substantially parallel longitudinal sides of the substantially C-shaped channel of the face plate clamping apparatus.

STILL YET ANOTHER OBJECT of the present invention is to provide a helmet rigid flashlight bracket wherein the face plate clamping apparatus further includes a generally rectangular-shaped gripper plate that has a textured upper surface, a flat lower surface that is substantially parallel to the textured upper surface of the generally rectangular-shaped gripper plate of the face plate clamping apparatus, and a substantially oval-shaped throughbore that is disposed at a longitudinal center of the generally rectangular-shaped gripper plate of the face plate clamping apparatus and in proximity to a rearwardmost long side of the generally rectangular-shaped gripper plate of the face plate clamping apparatus.

YET STILL ANOTHER OBJECT of the present invention is to provide a helmet rigid flashlight bracket wherein the substantially oval-shaped throughbore of the generally rectangular-shaped gripper plate of the face plate clamping apparatus is slightly larger than the substantially circular-shaped throughbore of the uppermost side of the pair of opposing and substantially parallel longitudinal sides of the substantially C-shaped channel of the face plate clamping apparatus and the substantially circular-shaped throughbore of the lowermost side of the pair of opposing and substantially parallel longitudinal sides of the substantially C-shaped channel of the face plate clamping apparatus.

STILL YET ANOTHER OBJECT of the present invention is to provide a helmet rigid flashlight bracket wherein the generally rectangular-shaped gripper plate of the face plate clamping apparatus is movably positioned in the substantially C-shaped channel of the face plate clamping apparatus with the flat lower surface of the generally rectangular-shaped gripper plate of the face plate clamping apparatus resting on the pair of thumbscrews of the face plate clamping apparatus.

YET STILL ANOTHER OBJECT of the present invention is to provide a helmet rigid flashlight bracket wherein the generally rectangular-shaped gripper plate of the face plate clamping apparatus is movably maintained in the substantially C-shaped channel of the face plate clamping apparatus by a frictionally engagable pin that passes fixedly through the substantially circular-shaped throughbore of the uppermost side of the pair of opposing and substantially parallel longitudinal sides of the substantially C-shaped channel of the face plate clamping apparatus where the frictionally engagable pin of the face plate clamping apparatus is frictionally secured thereto, passes movably through the substantially oval-shaped throughbore of the generally rectangular-shaped gripper plate of the face plate clamping apparatus which is vertically aligned with the substantially circular-shaped throughbore of the uppermost side of the pair of opposing and substantially parallel longitudinal sides of the substantially C-shaped channel of the face plate clamping apparatus, and passes fixedly through the substantially circular-shaped throughbore of the lowermost side of the pair of opposing and substantially parallel longitudinal sides of the substantially C-shaped channel of the clamping apparatus where the frictionally engagable pin of the face plate clamping apparatus is frictionally secured thereto, so that the frictionally engagable pin of the face plate clamping apparatus is fixedly attached to the substantially C-shaped channel of the face plate clamping apparatus with the generally rectangular-shaped gripper plate of the face plate clamping apparatus movable therealong when the pair of thumbscrews of the face plate clamping apparatus are rotated and tightening the pair of thumbscrews of the face plate clamping apparatus further causes the generally rectangular-shaped gripper plate of the face plate clamping apparatus to move upwardly along the frictionally engagable pin of the face plate clamping apparatus and further secures the helmet rigid flashlight bracket to the portion of the brim of the helmet.

FINALLY, STILL YET ANOTHER OBJECT of the present invention is to provide a method of using a helmet rigid flashlight bracket that is replaceably and securingly attachable to a portion of a brim of a helmet that is wearable by a user and replaceably and securingly receives a flashlight of a variety of different flashlights each of which has a handle portion and a light emitting portion that emits a light beam that points substantially at eye level in the forward direction of the user that includes the steps of loosening a threaded set screw of an elongated, slightly arcuate-shaped, and narrow portion of an elongated and substantially L-shaped forwardmost retainer of the helmet rigid flashlight bracket and a threaded set screw of an elongated, slightly arcuate-shaped, and narrow portion of an elongated and substantially L-shaped rearwardmost retainer, placing the handle portion of the flashlight of the variety of different flashlights in a flashlight receptacle chamber of the helmet rigid flashlight bracket with the light emitting portion of the flashlight of the variety of different flashlights facing towards the elongated wide portion of the elongated and substantially L-shaped forwardmost retainer, tightening the threaded set screw of the elongated, slightly arcuate-shaped, and narrow portion of the elongated and substantially L-shaped forwardmost retainer and the threaded set screw of the elongated, slightly arcuate-shaped, and narrow portion of the elongated and substantially L-shaped rearwardmost retainer, so that the handle portion of the flashlight of the variety of different flashlights is replaceably secured in the flashlight receptacle chamber, orientating the helmet rigid flashlight bracket with the light emitting portion of the flashlight of the variety of different flashlights facing forward, positioning replaceably the helmet rigid flashlight bracket on the portion of the brim of the helmet with a substantially C-shaped channel of face plate clamping apparatus of the helmet rigid flashlight bracket replaceably receiving the portion of the brim of the helmet, and tightening a pair of thumbscrews of the face plate clamping apparatus until the helmet rigid flashlight bracket is replaceably secured to the portion of the brim of the helmet.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 6 is a diagrammatic outer side elevational view taken in the direction of arrow 6 in FIG. 5;

FIG. 7 is a diagrammatic top plan view taken in the direction of arrow 7 in FIGS. 5 and 6;

FIG. 8 is a diagrammatic front elevational view of an embodiment of the substantially C-shaped channel of the clamping arrangement taken in the direction of arrow 8 in FIG. 7 with parts broken away;

FIG. 9 is a diagrammatic outer side elevational view of another embodiment of the clamping arrangement;

FIG. 10 is a diagrammatic top plan view taken in the direction of arrow 10 in FIG. 9;

FIG. 11 is an enlarged diagrammatic partially exploded front elevational view taken in the direction of arrow 11 in FIG. 9; and FIG. 12 is a top plan view of the pressure plate.

LIST OF REFERENCE NUMERALS UTILIZED IN THE DRAWING

Preferred Embodiment

Figure 1:
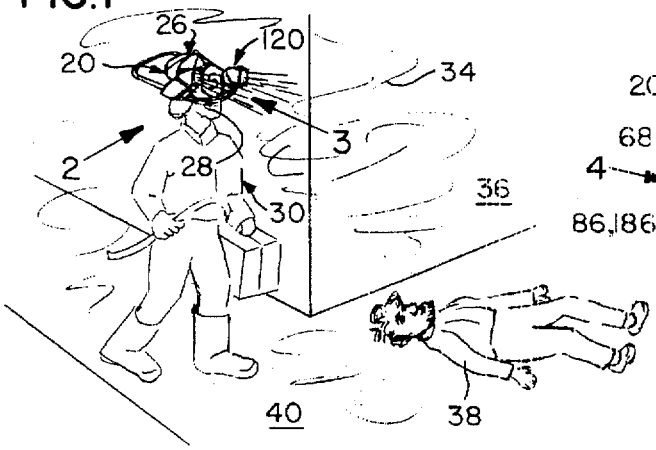
FIG. 1 is a diagrammatic perspective view illustrating a fire-fighter utilizing the present invention.

20 right side version of the helmet rigid flashlight bracket of the present invention

22 helmet brim right side

24 helmet brim

26 helmet

28 user head

30 user

32 LIFELITE(TM) flashlight

34 smoke

36 room

38 victim

40 room floor

42 flat, thin and generally rectangular-shaped upper face plate

44 upper face plate flat interior surface

46 upper face plate flat exterior surface

48 upper face plate straight top edge

50 upper face plate imaginary bottom line

52 pair of upper face plate opposing, substantially parallel, and straight long sides

54 flat, thin and generally 30–60 degree-right-triangular-shaped lower face plate

56 lower face plate flat interior surface

58 lower face plate flat exterior surface

60 lower face plate imaginary long base line

62 lower face plate short and straight rearmost edge

64 lower face plate straight hypothenuse edge

66 elongated and substantially L-shaped forwardmost retainer

70 forwardmost retainer elongated, slightly arcuate-shaped, and narrow portion

72 forwardmost retainer narrow portion substantially centrally-disposed threaded throughbore

74 forwardmost retainer narrow portion threaded set screw

76 elongated and substantially L-shaped rearwardmost retainer

78 rearward retainer elongated and wide portion

80 rearwardmost retainer elongated, slightly arcuate-shaped, and narrow portion

82 rearwardmost retainer narrow portion threaded throughbore

85 clamping arrangement

84 rearwardmost retainer narrow portion threaded set screw

86 clamping arrangement substantially C-shaped channel

87 flashlight receptacle chamber

88 clamping arrangement channel base part

90 pair of clamping arrangement channel opposing and substantially parallel longitudinal sides

92 pair of clamping arrangement channel lowermost side spaced-apart, generally aligned, and threaded throughbores

94 pair of clamping arrangement thumbscrews

120 left side version of the helmet rigid flashlight bracket of the present invention is shown generally

122 helmet brim left side

Alternate Embodiment

185 alternate embodiment of clamping arrangement

186 clamping arrangement substantially C-shaped channel

188 clamping arrangement channel base part

190 pair of clamping arrangement channel opposing and substantially parallel longitudinal sides

191 clamping arrangement upper most side substantially circular-shaped throughbore

192 pair of clamping arrangement channel lowermost side spaced-apart, generally aligned, and threaded throughbores

193 clamping arrangement lowermost side substantially circular-shaped throughbore

194 pair of clamping arrangement thumbscrews

196 clamping arrangement generally rectangular-shaped gripper plate

198 clamping arrangement gripper plate textured upper surface

200 clamping arrangement gripper plate lower surface

202 clamping arrangement gripper plate substantially oval-shaped throughbore

204 clamping arrangement frictionally engagable pin

DETAILED DESCRIPTION OF THE PREFERRED EMBODIMENT

Figure 3:
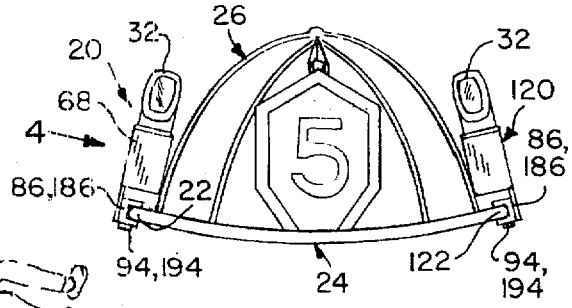
FIG. 3 is an enlarged diagrammatic front elevational view taken in the direction of arrow 3 in FIGS. 1 and 2.
Figure 2:
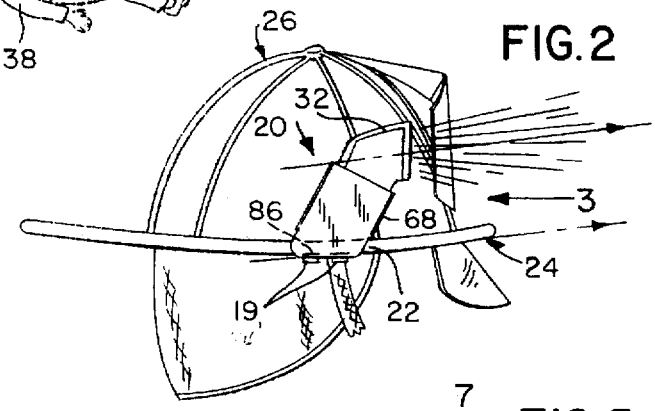
FIG. 2 is an enlarged diagrammatic side elevational view taken in the direction of arrow 2 in FIG. 1.
Figure 4:
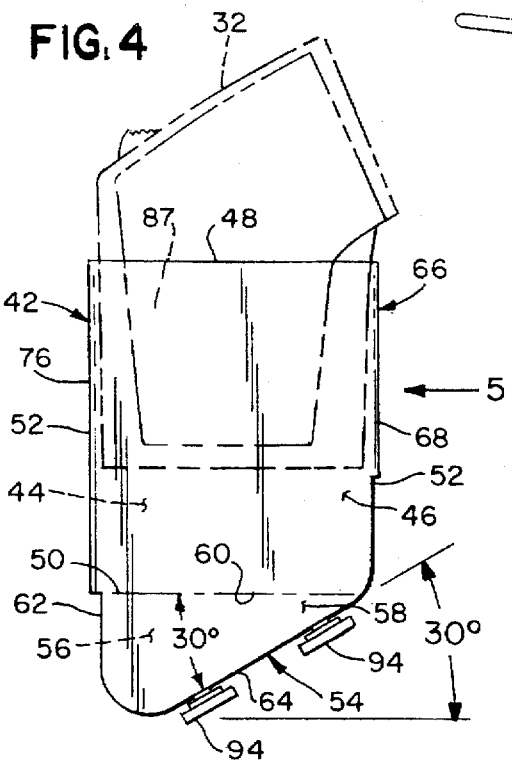
FIG. 4 is an enlarged diagrammatic side elevational view of the present invention illustrating a LIFELITE(TM) flashlight in phantom replaceably secured therein.
Figure 5:
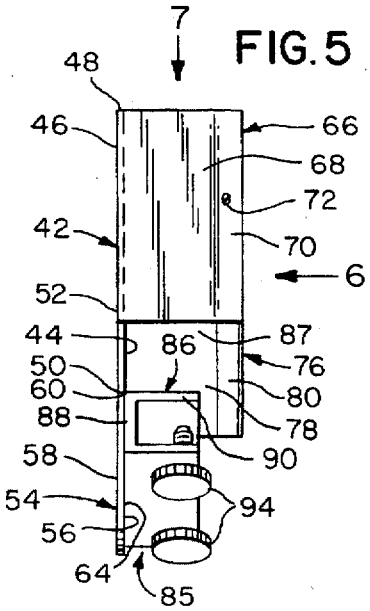
FIG. 5 is a diagrammatic front elevational view taken in the direction of arrow 5 in FIG. 4.

Referring now to the figures in which like numerals indicate like parts, and particularly to FIGS. 1–3, a right side version of the helmet rigid flashlight bracket of the present invention is shown generally at 20 replaceably mounted to a helmet brim right side 22 of a helmet brim 24 of a helmet 26 that is replaceably worn on a user head 28 of a user 30 and replaceably securingly receiving a LIFELITE(TM) flashlight 32, and a left side version of the helmet rigid flashlight bracket of the present invention is shown generally at 120 replaceably mounted to a helmet brim left side 122 of the helmet brim 24 of the helmet 26 and replaceably securingly receiving another LIFELITE(TM) flashlight 32.

As shown in FIG. 1, the right side version of the helmet rigid flashlight bracket 20 and the left side version of the helmet rigid flashlight bracket 120 are both being used by the user 30 to illuminate a path through smoke 34 in a room 36 to a victim 38 lying on a room floor 40 of the room 36.

The helmet rigid flashlight bracket 20, 120 is aluminum, so that when worn by the user 30, who is a fire-fighter, the helmet rigid flashlight bracket 20, 120 will not corrode and be damaged by water and the smoke 34 and pollutants generated by a fire.

It is to be understood, however, that either or both of the right side version of the helmet rigid flashlight bracket 20 and the left side version of the helmet rigid flashlight bracket 120 can be used depending on the preference and needs of the user 30.

Since the left side version of the helmet rigid flashlight bracket 120 is merely a mirror image of the right side version of the helmet rigid flashlight bracket 20 and for the sake of brevity, only the right side version of the helmet rigid flashlight bracket 20 will be discussed, infra.

The configuration of the right side version of the helmet rigid flashlight bracket 20 can best be seen in FIGS. 4–7, and as such will be discussed with reference thereto.

The right side version of the helmet rigid flashlight bracket 20 includes a flat, thin and generally rectangular-shaped upper face plate 42 that is aluminum sheet metal and has an upper face plate flat interior surface 44, an upper face plate flat exterior surface 46 that is substantially parallel to the upper face plate flat interior surface 44 of the flat, thin and generally rectangular-shaped upper face plate 42, an upper face plate straight top edge 48, an upper face plate imaginary bottom line 50 that is below, and substantially parallel to, the upper face plate straight top edge 48 of the flat, thin and generally rectangular-shaped upper face plate 42, and a pair of upper face plate opposing, substantially parallel, and straight long sides 52 that extend from the ends of the upper face plate straight top edge 48 of the flat, thin and generally rectangular-shaped upper face plate 42 to the ends of the upper face plate imaginary bottom line 50 of the flat, thin and generally rectangular-shaped upper face plate 42.

The right side version of the helmet rigid flashlight bracket 20 further includes a flat, thin and generally 30–60 degree-right-triangular-shaped lower face plate 54 that is aluminum sheet metal, is integral and co-planar with, and extends downwardly from, the flat, thin and generally rectangular-shaped upper face plate 42.

The flat, thin and generally 30–60 degree-right-triangular-shaped lower face plate 54 has a lower face plate flat interior surface 56 that is continuous and co-planar with the upper face plate flat interior surface 44 of the flat, thin and generally rectangular-shaped upper face plate 42, a lower face plate flat exterior surface 58 that is substantially parallel to the lower face plate flat interior surface 56 of the flat, thin and generally 30–60 degree-right-triangular-shaped lower face plate 54 and is continuous and co-planar with the upper face plate flat exterior surface 46 of the flat, thin and generally rectangular-shaped upper face plate 42, a lower face plate imaginary long base line 60 that is coincident and continuous and co-planar with the upper face plate imaginary bottom line 50 of the flat, thin and generally rectangular-shaped upper face plate 42, a lower face plate short and straight rearmost edge 62 that extends downwardly at a highermost end from, and is collinear with, the lowermost end of a rearmost side of the pair of upper face plate opposing, substantially parallel, and straight long sides 52 of the flat, thin and generally rectangular-shaped upper face plate 42, and a lower face plate straight hypothenuse edge 64 that extends downwardly and rearwardly at a forwardmost end, at an angle of approximately 30 degrees, from the lowermost end of the forwardmost side of the pair of upper face plate opposing, substantially parallel, and straight long sides 52 of the flat, thin and generally rectangular-shaped upper face plate 42 to the lowermost end of the lower face plate short and straight rearmost side 62 of the flat, thin and generally 30–60 degree-right-triangular-shaped lower face plate 54.

The point of intersection between the forwardmost end of the lower face plate straight hypothenuse edge of the flat, thin and generally 30–60 degree-right-triangular-shaped lower face plate 54 and the lowermost end of the forwardmost side of the pair of upper face plate opposing, substantially parallel, and straight long sides 52 of the flat, thin and generally rectangular-shaped upper face plate 42 and the point of intersection between the lowermost end of the lower face plate short and straight rearmost side 62 of the flat, thin and generally 30–60 degree-right-triangular-shaped lower face plate 54 and the rearmost end of the lower face plate straight hypothenuse edge of the flat, thin and generally 30–60 degree-right-triangular-shaped lower face plate 54 are rounded for safety so as to avoid injury to the user 30.

The right side version of the helmet rigid flashlight bracket 20 further includes an elongated and substantially L-shaped forwardmost retainer 66 that is aluminum sheet metal and has a forwardmost retainer elongated and wide portion 68 that is integral with, and is bent generally normally-outwardly from, the forwardmost side of the pair of upper face plate opposing, substantially parallel, and straight long sides 52 of the flat, thin and generally rectangular-shaped upper face plate 42, in the direction of the upper face plate flat interior surface 44 of the flat, thin and generally rectangular-shaped upper face plate 42, from forwardmost end of the upper face plate straight top edge 48 of the flat, thin and generally rectangular-shaped upper face plate 42 to a distance short of the forwardmost end of the upper face plate imaginary bottom line 50 of the flat, thin and generally rectangular-shaped upper face plate 42.

The elongated and substantially L-shaped forwardmost retainer 66 further has a forwardmost retainer elongated, slightly arcuate-shaped, and narrow portion 70 that is bent generally normally and smoothly inwardly and slightly outwardly from the forwardmost retainer elongated wide portion 68 of the elongated and substantially L-shaped forwardmost retainer 66, towards the center of the upper face plate flat interior surface 44 of the flat, thin and generally rectangular-shaped upper face plate 42.

The forwardmost retainer elongated, slightly arcuate-shaped, and narrow portion 70 of the elongated and substantially L-shaped forwardmost retainer 66 has a forwardmost retainer narrow portion substantially centrally-disposed threaded throughbore 72 that extends laterally through the substantial center of the forwardmost retainer elongated, slightly arcuate-shaped, and narrow portion 70 of the elongated and substantially L-shaped forwardmost retainer 66.

The forwardmost retainer elongated, slightly arcuate-shaped, and narrow portion 70 of the elongated and substantially L-shaped forwardmost retainer 66 further has a forwardmost retainer narrow portion threaded set screw 74 that threadably engages the forwardmost retainer narrow portion substantially centrally-disposed threaded throughbore 72 of the forwardmost retainer elongated, slightly arcuate-shaped, and narrow portion 70 of the elongated and substantially L-shaped forwardmost retainer 66.

The right side version of the helmet rigid flashlight bracket 20 further includes an elongated and substantially L-shaped rearwardmost retainer 76 that is aluminum sheet metal and has a rearward retainer elongated and wide portion 78 that is substantially parallel to the forwardmost retainer elongated wide portion 68 of the elongated and substantially L-shaped forwardmost retainer 66, and is integral with, and is bent generally normally-outwardly from the rearwardmost side of the pair of upper face plate opposing, substantially parallel, and straight long sides 52 of the flat, thin and generally rectangular-shaped upper face plate 42, in the direction of the upper face plate flat interior surface 44 of the flat, thin and generally rectangular-shaped upper face plate 42, from the rearwardmost end of the upper face plate straight top edge 48 of the flat, thin and generally rectangular-shaped upper face plate 42 to the rearwardmost end of the upper face plate imaginary bottom line 50 of the flat, thin and generally rectangular-shaped upper face plate 42.

The elongated and substantially L-shaped rearwardmost retainer 76 further has a rearwardmost retainer elongated, slightly arcuate-shaped, and narrow portion 80 that is substantially co-planar with the forwardmost retainer elongated and narrow portion 70 of the elongated and substantially L-shaped forwardmost retainer 66 and extends generally normally-smoothly-inwardly towards the center of the upper face plate flat interior surface 44 of the flat, thin and generally rectangular-shaped upper face plate 42 and slightly outwardly therefrom along the rearwardmost retainer elongated wide portion 78 of the elongated and substantially L-shaped rearwardmost retainer 76.

The rearwardmost retainer elongated, slightly arcuate-shaped, and narrow portion 80 of the elongated and substantially L-shaped rearwardmost retainer 76 has a rearwardmost retainer narrow portion threaded throughbore 82 that extends laterally therethrough in substantial alignment with the forwardmost retainer narrow portion substantially centrally-disposed threaded throughbore 72 of the forwardmost retainer elongated, slightly arcuate-shaped, and narrow portion 70 of the elongated and substantially L-shaped forwardmost retainer 66.

The rearwardmost retainer elongated and narrow portion 80 of the elongated and substantially L-shaped rearwardmost retainer 76 further has a rearwardmost retainer narrow portion threaded set screw 84 that threadably engages the rearwardmost retainer narrow portion threaded throughbore 82 of the rearwardmost retainer elongated, slightly arcuate-shaped and narrow portion 80 of the elongated and substantially L-shaped rearwardmost retainer 76.

The elongated and substantially L-shaped forwardmost retainer 66, the elongated and substantially L-shaped rearwardmost retainer 76, and the upper face plate flat interior surface 44 of the flat, thin and generally rectangular-shaped upper face plate 42 define a flashlight receptacle chamber 87 that replaceably receives the flashlight 32 therein.

The forwardmost retainer narrow portion threaded set screw 74 of the forwardmost retainer elongated, slightly arcuate-shaped, and narrow portion 70 of the elongated and substantially L-shaped forwardmost retainer 66 and the rearwardmost retainer narrow portion threaded set screw 84 of the rearwardmost retainer elongated and narrow portion 80 of the elongated and substantially L-shaped rearwardmost retainer 76 replaceably secure the flashlight 32 in the flashlight receptacle chamber 87.

The right side version of the helmet rigid flashlight bracket 20 further includes a clamping arrangement 85 that has a clamping arrangement substantially C-shaped channel 86 that is aluminum and has a clamping arrangement channel base part 88 that is spot welded to the lower face plate flat interior surface 56 of the flat, thin and generally 30–60 degree-right-triangular-shaped lower face plate 54 along, and not overlaying, the lower face plate straight hypothenuse edge 64 of the flat, thin and generally 30–60 degree-right-triangular-shaped lower face plate 54, and a pair of clamping arrangement channel opposing and substantially parallel longitudinal sides 90 that extend normally-outwardly from the longitudinal sides of the clamping arrangement channel base part 88 of the clamping arrangement substantially C-shaped channel 86 of the clamping arrangement 85.

The lowermost side of the pair of clamping arrangement channel opposing and substantially parallel longitudinal sides 90 of the clamping arrangement substantially C-shaped channel 86 of the clamping arrangement 85, which is in alignment with the lower face plate straight hypothenuse edge 64 of the flat, thin and generally 30–60 degree-right-triangular-shaped lower face plate 54, has a pair of clamping arrangement channel lowermost side spaced-apart, generally aligned, and threaded throughbores 92 that pass laterally therethrough.

The clamping arrangement 85 further includes a pair of clamping arrangement thumbscrews 94. Each thumbscrew of the pair of clamping arrangement thumbscrews 94 of the clamping arrangement 85 threadably engages a respective throughbore of the pair of clamping arrangement channel lowermost side spaced-apart, generally aligned, and threaded throughbores 92 of the lowermost side of the pair of clamping arrangement channel opposing and substantially parallel sides 90 of the clamping arrangement substantially C-shaped channel 86 of the clamping arrangement 85.

The clamping arrangement substantially C-shaped channel 86 of the clamping arrangement 85 replaceably receives the helmet brim right side right side 22 of the helmet brim 24 of the helmet 26 while the tightening of the pair of clamping arrangement thumbscrews 94 of the clamping arrangement 85 secures the helmet brim right side right side 22 of the helmet brim 24 of the helmet 26 therein.

An alternate embodiment of a clamping arrangement 185 can best be seen in FIGS. 9–12, and as such will be discussed with reference thereto.

The clamping arrangement 185 has a clamping arrangement substantially C-shaped channel 186 that is aluminum and has a clamping arrangement channel base part 188 that is spot welded to the lower face plate flat interior surface 56 of the flat, thin and generally 30–60 degree-right-triangular-shaped lower face plate 54 along, and not overlaying, the lower face plate straight hypothenuse edge 64 of the flat, thin and generally 30–60 degree-right-triangular-shaped lower face plate 54, and a pair of clamping arrangement channel opposing and substantially parallel longitudinal sides 190 that extend normally-outwardly from the longitudinal sides of the clamping arrangement channel base part 188 of the clamping arrangement substantially C-shaped channel 186 of the clamping arrangement 185.

The uppermost side of the pair of clamping arrangement channel opposing and substantially parallel longitudinal sides 190 of the clamping arrangement substantially C-shaped channel 186 of the clamping arrangement 185 has a clamping arrangement upper most side substantially circular-shaped throughbore 191 that is disposed at the general longitudinal center of the uppermost side of the pair of clamping arrangement channel opposing and substantially parallel longitudinal sides 190 of the clamping arrangement substantially C-shaped channel 186 of the clamping arrangement 185, and in proximity to the clamping arrangement channel base part 188 of the clamping arrangement substantially C-shaped channel 186 of the clamping arrangement 185.

The lowermost side of the pair of clamping arrangement channel opposing and substantially parallel longitudinal sides 190 of the clamping arrangement substantially C-shaped channel 186 of the clamping arrangement 185, which is in alignment with the lower face plate straight hypothenuse edge 64 of the flat, thin and generally 30–60 degree-right-triangular-shaped lower face plate 54, has a pair of clamping arrangement channel lowermost side spaced-apart, generally aligned, and threaded throughbores 192 that pass laterally therethrough.

The lowermost side of the pair of clamping arrangement channel opposing and substantially parallel longitudinal sides 190 of the clamping arrangement substantially C-shaped channel 186 of the clamping arrangement 185 further has a clamping arrangement lowermost side substantially circular-shaped throughbore 193 that is disposed at the general longitudinal center of the lowermost side of the pair of clamping arrangement channel opposing and substantially parallel longitudinal sides 190 of the clamping arrangement substantially C-shaped channel 186 of the clamping arrangement 185, between the pair of clamping arrangement channel lowermost side spaced-apart, generally aligned, and threaded throughbores 192 of the lowermost side of the pair of clamping arrangement channel opposing and substantially parallel longitudinal sides 190 of the clamping arrangement substantially C-shaped channel 186 of the clamping arrangement 185 and the clamping arrangement channel base part 188 of the clamping arrangement substantially C-shaped channel 186 of the clamping arrangement 185, and in vertical alignment with the clamping arrangement upper most side substantially circular-shaped throughbore 191 of the uppermost side of the pair of clamping arrangement channel opposing and substantially parallel longitudinal sides 190 of the clamping arrangement substantially C-shaped channel 186 of the clamping arrangement 185.

The clamping arrangement 185 further includes a pair of clamping arrangement thumbscrews 194. Each thumbscrew of the pair of clamping arrangement thumbscrews 194 of the clamping arrangement 185 threadably engages a respective throughbore of the pair of clamping arrangement channel lowermost side spaced-apart, generally aligned, and threaded throughbores 192 of the lowermost side of the pair of clamping arrangement channel opposing and substantially parallel sides 190 of the clamping arrangement substantially C-shaped channel 186 of the clamping arrangement.

The clamping arrangement 185 further includes a clamping arrangement generally rectangular-shaped gripper plate 196 that has a clamping arrangement gripper plate textured upper surface 198, a clamping arrangement gripper plate lower surface 200 that is substantially parallel to the clamping arrangement gripper plate textured upper surface 198 of the clamping arrangement generally rectangular-shaped gripper plate 196 of the clamping arrangement 185, and a clamping arrangement gripper plate substantially oval-shaped throughbore 202 that is disposed at the general longitudinal center of the clamping arrangement generally rectangular-shaped gripper plate 196 of the clamping arrangement 185 and in proximity to rearwardmost long side of the clamping arrangement generally rectangular-shaped gripper plate 196 of the clamping arrangement 185.

The clamping arrangement gripper plate substantially oval-shaped throughbore 202 of the clamping arrangement generally rectangular-shaped gripper plate 196 of the clamping arrangement 185 is slightly larger than the clamping arrangement upper most side substantially circular-shaped throughbore 191 of the uppermost side of the pair of clamping arrangement channel opposing and substantially parallel longitudinal sides 190 of the clamping arrangement substantially C-shaped channel 186 of the clamping arrangement 185 and the clamping arrangement lowermost side substantially circular-shaped throughbore 193 of the lowermost side of the pair of clamping arrangement channel opposing and substantially parallel longitudinal sides 190 of the clamping arrangement substantially C-shaped channel 186 of the clamping arrangement 185.

The clamping arrangement generally rectangular-shaped gripper plate 196 of the clamping arrangement 185 is movably positioned in the clamping arrangement substantially C-shaped channel 186 of the clamping arrangement 185 with the clamping arrangement gripper plate lower surface 200 of the clamping arrangement generally rectangular-shaped gripper plate 196 of the clamping arrangement 185 resting on the pair of clamping arrangement thumbscrews 194 of the clamping arrangement 185.

The clamping arrangement generally rectangular-shaped gripper plate 196 of the clamping arrangement 185 is movably maintained in the clamping arrangement substantially C-shaped channel 186 of the clamping arrangement 185 by a clamping arrangement frictionally engagable pin 204, sold under the trademark ROLLPIN(R) that passes fixedly through the clamping arrangement upper most side substantially circular-shaped throughbore 191 of the uppermost side of the pair of clamping arrangement channel opposing and substantially parallel longitudinal sides 190 of the clamping arrangement substantially C-shaped channel 186 of the clamping arrangement 185 where it is frictionally secured thereto, passes movably through the clamping arrangement gripper plate substantially oval-shaped throughbore 202 of the clamping arrangement generally rectangular-shaped gripper plate 196 of the clamping arrangement 185 which is vertically aligned with the clamping arrangement upper most side substantially circular-shaped throughbore 191 of the uppermost side of the pair of clamping arrangement channel opposing and substantially parallel longitudinal sides 190 of the clamping arrangement substantially C-shaped channel 186 of the clamping arrangement 185, and passes fixedly through the clamping arrangement lowermost side substantially circular-shaped throughbore 193 of the lowermost side of the pair of clamping arrangement channel opposing and substantially parallel longitudinal sides 190 of the clamping arrangement substantially C-shaped channel 186 of the clamping arrangement 185 where it is frictionally secured thereto, so that the clamping arrangement frictionally engagable pin 204 is fixedly attached to the clamping arrangement substantially C-shaped channel 186 of the clamping arrangement 185 with the clamping arrangement generally rectangular-shaped gripper plate 196 of the clamping arrangement 185 movable therealong when the pair of clamping arrangement thumbscrews 194 of the clamping arrangement 185 are rotated.

The clamping arrangement substantially C-shaped channel 186 of the clamping arrangement 185 replaceably receives the helmet brim right side right side 22 of the helmet brim 24 of the helmet 26 while the tightening of the pair of clamping arrangement thumbscrews 194 of the clamping arrangement 185 causes the clamping arrangement generally rectangular-shaped gripper plate 196 of the clamping arrangement 185 to move upwardly along the clamping arrangement frictionally engagable pin 204 of the clamping arrangement 185 and secures the helmet brim right side right side 22 of the helmet brim 24 of the helmet 26 therein.

It is to be understood that the gist of the present invention is to provide a helmet rigid flashlight bracket 20, 120 that has the clamping arrangement substantially C-shaped channel 86, 186 of the clamping arrangement 85, 185 disposed on the lower edge thereof in such an orientation so as to be parallel to a beam of light emitted by the flashlight 32 that is being replaceably maintained therein (see FIG. 2). Thus, any shaped face plate accomplishing this end, so as to account for different shapes of the flashlight 32, can be used without departing in any way from the spirit of the present invention.

See In re Dailey et al., 149 U.S.P.Q. at 47 (CCPA 1976), where the Court held that the shape of a device must be considered in determining patentability, if the shape is significant:

> ". . . the configuration of the container is a 'mere matter of choice' not significantly novel. . . , [however,]. . . Appellants have provided no argument which convinces us that the particularconfiguration of their container is significant . . . " [Emphasis added]

The manner of using the helmet rigid flashlight bracket 20, 120 can best be seen in FIGS. 1–4, and as such will be discussed with reference thereto.

The forwardmost retainer narrow portion threaded set screw 74 of the forwardmost retainer elongated, slightly arcuate-shaped, and narrow portion 70 of the elongated and substantially L-shaped forwardmost retainer 66 and the rearwardmost retainer narrow portion threaded set screw 84 of the rearwardmost retainer elongated and narrow portion 80 of the elongated and substantially L-shaped rearwardmost retainer 76 are loosened, if necessary.

The flashlight handle portion of the flashlight 32 is placed in the flashlight receptacle chamber 87 with the flashlight light emitting portion of the flashlight 32 facing towards the forwardmost retainer elongated wide portion 68 of the elongated and substantially L-shaped forwardmost retainer 66.

The forwardmost retainer narrow portion threaded set screw 74 of the forwardmost retainer elongated, slightly arcuate-shaped, and narrow portion 70 of the elongated and substantially L-shaped forwardmost retainer 66 and the rearwardmost retainer narrow portion threaded set screw 84 of the rearwardmost retainer elongated and narrow portion 80 of the elongated and substantially L-shaped rearwardmost retainer 76 are tightened, so that the flashlight handle portion of the flashlight 32 is replaceably secured in the flashlight receptacle chamber 87.

The helmet rigid flashlight bracket 20,120 is oriented with the flashlight light emitting portion of the flashlight 32 facing forward.

The helmet rigid flashlight bracket 20,120 is replaceably positioned on the helmet 26 with the clamping arrangement substantially C-shaped channel 86, 186 of the clamping arrangement 85, 85 replaceably receiving the helmet brim 24 of the helmet 26.

The pair of clamping arrangement thumbscrews 94 of the clamping arrangement 85 are tightened until the helmet rigid flashlight bracket 20, 120 is replaceably secured to the helmet brim 24 of the helmet 26.

It will be understood that each of the elements described above, or two or more together, may also find a useful application in other types of constructions differing from the types described above.

While the invention has been illustrated and described as embodied in a helmet rigid flashlight bracket, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A helmet rigid flashlight bracket being replaceably and securingly attachable to a portion of a brim of a helmet being wearable by a user and replaceably and securingly receiving a flashlight of a variety of different flashlights each of which having a handle portion and a light emitting portion emitting a light beam pointing substantially at eye level in a forward direction of the user, comprising:

a) a face plate having a lower portion, wherein said face plate has a flat and thin and generally rectangular-shaped upper portion with flat interior surface that has a longitudinal center, a flat exterior surface that is substantially parallel to said flat interior surface of said flat, thin and generally rectangular-shaped upper portion of said face plate, a straight top edge with ends, an imaginary bottom line that has ends and is disposed below, and substantially parallel to, said straight top edge of said flat, thin and generally rectangular-shaped upper portion of said face plate, and a pair of opposing, substantially parallel, and straight long sides that extend from said ends of said straight top edge of said flat, thin and generally rectangular-shaped upper portion of said face plate to said ends of said imaginary bottom line of said flat, thin and generally rectangular-shaped upper portion of said face plate;

b) flashlight maintaining means being disposed on said face plate for replaceably and securingly maintaining the handle portion of the flashlight of the variety of different flashlights to said face plate;

c) a substantially C-shaped channel being disposed on said lower portion of said face plate in an orientation so as to be parallel to the light beam emitting from the light emitting portion of the flashlight of the variety of different flashlights; and d) face plate clamping means associated with said substantially C-shaped channel for replaceably and securingly clamping said face plate to the portion of the brim of the helmet, so that the light beam emitting from the light emitting portion of the flashlight of the variety of different flashlights points substantially at eye level in the forward direction of the user.

2. The bracket as defined in claim 1, wherein said helmet rigid flashlight bracket is made from aluminum, so that when worn by a fire-fighter said helmet rigid flashlight bracket will not corrode and will not be damaged by water and smoke and pollutants generated by a fire.

3. The bracket as defined in claim 1, wherein said lower portion of said face plate is a flat, thin and generally 30–60 degree-right-triangular-shaped lower portion that is integral and co-planar with, and extends downwardly from, said flat, thin and generally rectangular-shaped upper portion of said face plate; said flat, thin and generally 30–60 degree-right-triangular-shaped lower portion of said face plate has a flat interior surface that is continuous and co-planar with said flat interior surface of said flat, thin and generally rectangular-shaped upper portion of said face plate, a flat exterior surface that is substantially parallel to said flat interior surface of said flat, thin and generally 30–60 degree-right-triangular-shaped lower portion of said face plate and is continuous and co-planar with said flat exterior surface of said flat, thin and generally rectangular-shaped upper portion of said face plate, an imaginary long base line that is coincident and continuous and co-planar with said imaginary bottom line of said flat, thin and generally rectangular-shaped upper portion of said face plate, a short and straight rearwardmost edge that extends downwardly at a highermost end from, and is collinear with, a lowermost end of a rearwardmost side of said pair of opposing, substantially parallel, and straight long sides of said flat, thin and generally rectangular-shaped upper portion of said face plate, and a straight hypothenuse edge that extends downwardly and rearwardly at a forwardmost end, at an angle of approximately 30 degrees, from a lowermost end of a forwardmost side of said pair of opposing, substantially parallel, and straight long sides of said flat, thin and generally rectangular-shaped upper portion of said face plate to a lowermost end of said short and straight rearwardmost edge of said flat, thin and generally 30–60 degree-right-triangular-shaped lower portion.

4. The bracket as defined in claim 3, wherein a point of intersection between said forwardmost end of said straight hypothenuse edge of said flat, thin and generally 30–60 degree-right-triangular-shaped lower portion of said face plate and said lowermost end of said forwardmost side of said pair of opposing, substantially parallel, and straight long sides of said flat, thin and generally rectangular-shaped upper portion of said face plate and a point of intersection between said lowermost end of said short and straight rearmost side of said straight hypothenuse edge of said flat, thin and generally 30–60 degree-right-triangular-shaped lower portion of said face plate and said rearmost end of said straight hypothenuse edge of said flat, thin and generally 30–60 degree-right-triangular-shaped lower portion of said face plate are rounded for safety so as to avoid injury to the user.

5. The bracket as defined in claim 3, wherein said flashlight maintaining means includes an elongated and substantially L-shaped forwardmost retainer that has an elongated and wide portion that is integral with, and is bent generally normally-outwardly from, said forwardmost side of said pair of opposing, substantially parallel, and straight long sides of said flat, thin and generally rectangular-shaped upper portion of said face plate, in a direction of said flat interior surface of said flat, thin and generally rectangular-shaped upper portion of said face plate, from a forwardmost end of said ends of said straight top edge of said flat, thin and generally rectangular-shaped upper portion of said face plate to a distance short of a forwardmost end of said ends of said imaginary bottom line of said flat, thin and generally rectangular-shaped upper portion of said face plate.

6. The bracket as defined in claim 5, wherein said elongated and substantially L-shaped forwardmost retainer further has an elongated, slightly arcuate-shaped, and narrow portion that has a substantial center and is bent generally normally and smoothly inwardly and slightly outwardly from said elongated wide portion of said elongated and substantially L-shaped forwardmost retainer towards said longitudinal center of said flat interior surface of said flat, thin and generally rectangular-shaped upper portion of said face plate.

7. The bracket as defined in claim 6, wherein said elongated, slightly arcuate-shaped, and narrow portion of said elongated and substantially L-shaped forwardmost retainer has a substantially centrally-disposed threaded throughbore that extends laterally through said substantial center of said elongated, slightly arcuate-shaped, and narrow portion of said elongated and substantially L-shaped forwardmost retainer.

8. The bracket as defined in claim 7, wherein said elongated, slightly arcuate-shaped, and narrow portion of said elongated and substantially L-shaped forwardmost retainer further has a threaded set screw that threadably engages said substantially centrally-disposed threaded throughbore of said elongated, slightly arcuate-shaped, and narrow portion of said elongated and substantially L-shaped forwardmost retainer.

9. The bracket as defined in claim 7, wherein said flashlight maintaining means further includes an elongated and substantially L-shaped rearwardmost retainer that has an elongated and wide portion that is substantially parallel to said elongated wide portion of said elongated and substantially L-shaped forwardmost retainer, and is integral with, and is bent generally normally-outwardly from a rearwardmost side of said pair of opposing, substantially parallel, and straight long sides of said flat, thin and generally rectangular-shaped upper portion of said face plate, in said direction of said flat interior surface of said flat, thin and generally rectangular-shaped upper portion of said face plate, from a rearwardmost end of said ends of said straight top edge of said flat, thin and generally rectangular-shaped upper portion of said face plate to a rearwardmost end of said ends of said imaginary bottom line of said flat, thin and generally rectangular-shaped upper portion of said face plate; said elongated and substantially L-shaped forwardmost retainer, said elongated and substantially L-shaped rearwardmost retainer, and said flat interior surface of said flat, thin and generally rectangular-shaped upper portion of said face plate define a flashlight receptacle chamber that replaceably receives the handle portion of the flashlight of the variety of different flashlights therein.

10. The bracket as defined in claim 9, wherein said elongated and substantially L-shaped rearwardmost retainer further has an elongated, slightly arcuate-shaped, and narrow portion that has a substantial center and is substantially co-planar with said elongated, slightly arcuate-shaped, and narrow portion of said elongated and substantially L-shaped forwardmost retainer and is bent generally normally smooth inwardly and slightly outwardly from said elongated wide portion of said elongated and substantially L-shaped rearwardmost retainer towards said longitudinal center of said flat interior surface of said flat, thin and generally rectangular-shaped upper portion of said face plate.

11. The bracket as defined in claim 10, wherein said elongated, slightly arcuate-shaped, and narrow portion of said elongated and substantially L-shaped rearwardmost retainer has a threaded throughbore that extends laterally therethrough in substantial alignment with said substantially centrally-disposed threaded throughbore of said elongated, slightly arcuate-shaped, and narrow portion of said elongated and substantially L-shaped forwardmost retainer.

12. The bracket as defined in claim 11, wherein said elongated, slightly arcuate-shaped, and narrow portion of said elongated and substantially L-shaped rearwardmost retainer further has a threaded set screw that threadably engages said threaded throughbore of said elongated, slightly arcuate-shaped, and narrow portion of said elongated and substantially L-shaped rearwardmost retainer; said threaded set screw of said elongated, slightly arcuate-shaped, and narrow portion of said elongated and substantially L-shaped forwardmost retainer and said threaded set screw of said elongated, slightly arcuate-shaped, and narrow portion of said elongated and substantially L-shaped rearwardmost retainer replaceably and securingly maintain the handle portion of the flashlight of the variety of different flashlights in said flashlight receptacle chamber.

13. The bracket as defined in claim 3, wherein said face plate clamping means includes said substantially C-shaped channel that has a base part with longitudinal sides and is spot welded to said flat interior surface of said flat, thin and generally 30–60 degree-right-triangular-shaped lower portion of said face plate along, and not overlaying, said straight hypothenuse edge of said flat, thin and generally 30–60 degree-right-triangular-shaped lower portion of said face plate, and a pair of opposing and substantially parallel longitudinal sides that extend normally-outwardly from said longitudinal sides of said base part of said substantially C-shaped channel of said face plate clamping means.

14. The bracket as defined in claim 13, wherein a lowermost side of said pair of opposing and substantially parallel longitudinal sides of said substantially C-shaped channel of said face plate clamping means, which is in alignment with said straight hypothenuse edge of said flat, thin and generally 30–60 degree-right-triangular-shaped lower portion of said face plate, has a pair of spaced-apart, generally aligned, and threaded throughbores that pass laterally therethrough.

15. The bracket as defined in claim 14, wherein said face plate clamping means further includes a pair of thumbscrews, each of which engages a respective throughbore of said pair of spaced-apart, generally aligned, and threaded throughbores of said lowermost side of said pair of opposing and substantially parallel sides of said substantially C-shaped channel of said face plate clamping means, so that said substantially C-shaped channel of said face plate clamping means replaceably receives the portion of the brim of the helmet while tightening of said pair of thumbscrews of said face plate clamping means replaceably secures said helmet rigid flashlight bracket to the portion of the brim of the helmet and maintains the light beam emitting from the light emitting portion of the flashlight of the variety of different flashlights substantially at eye level in the forward direction of the user.

16. The bracket as defined in claim 15, wherein an uppermost side of said pair of opposing and substantially parallel longitudinal sides of said substantially C-shaped channel of said face plate clamping means has a substantially circular-shaped throughbore that is disposed at a longitudinal center of said uppermost side of said pair of opposing and substantially parallel longitudinal sides of said substantially C-shaped channel of said face plate clamping means, and in proximity to said base part of said substantially C-shaped channel of said face plate clamping means; said lowermost side of said pair of opposing and substantially parallel longitudinal sides of said substantially C-shaped channel of said face plate clamping means further has a substantially circular-shaped throughbore that is disposed at a longitudinal center of said lowermost side of said pair of opposing and substantially parallel longitudinal sides of said substantially C-shaped channel of said face plate clamping means, between said pair of spaced-apart, generally aligned, and threaded throughbores of said lowermost side of said pair of opposing and substantially parallel longitudinal sides of said substantially C-shaped channel of said face plate clamping means and said base part of said substantially C-shaped channel of said face plate clamping means, and in vertical alignment with said substantially circular-shaped throughbore of said uppermost side of said pair of opposing and substantially parallel longitudinal sides of said substantially C-shaped channel of said face plate clamping means.

17. The bracket as defined in claim 16, wherein said face plate clamping means further includes a generally rectangular-shaped gripper plate that has a textured upper surface, a flat lower surface that is substantially parallel to said textured upper surface of said generally rectangular-shaped gripper plate of said face plate clamping means, and a substantially oval-shaped throughbore that is disposed at a longitudinal center of said generally rectangular-shaped gripper plate of said face plate clamping means and in proximity to a rearwardmost long side of said generally rectangular-shaped gripper plate of said face plate clamping means.

18. The bracket as defined in claim 17, wherein said substantially oval-shaped throughbore of said generally rectangular-shaped gripper plate of said face plate clamping means is slightly larger than said substantially circular-shaped throughbore of said uppermost side of said pair of opposing and substantially parallel longitudinal sides of said substantially C-shaped channel of said face plate clamping means and said substantially circular-shaped throughbore of said lowermost side of said pair of opposing and substantially parallel longitudinal sides of said substantially C-shaped channel of said face plate clamping means.

19. The bracket as defined in claim 18, wherein said generally rectangular-shaped gripper plate of said face plate clamping means is movably positioned in said substantially C-shaped channel of said face plate clamping means with said flat lower surface of said generally rectangular-shaped gripper plate of said face plate clamping means resting on said pair of thumbscrews of said face plate clamping means; said generally rectangular-shaped gripper plate of said face plate clamping means is movably maintained in said substantially C-shaped channel of said face plate clamping means by a frictionally engagable pin that passes fixedly through said substantially circular-shaped throughbore of said uppermost side of said pair of opposing and substantially parallel longitudinal sides of said substantially C-shaped channel of said face plate clamping means where said frictionally engagable pin of said face plate clamping means is frictionally secured thereto, passes movably through said substantially oval-shaped throughbore of said generally rectangular-shaped gripper plate of said face plate clamping means which is vertically aligned with said substantially circular-shaped throughbore of said uppermost side of said pair of opposing and substantially parallel longitudinal sides of said substantially C-shaped channel of said face plate clamping means, and passes fixedly through said substantially circular-shaped throughbore of said lowermost side of said pair of opposing and substantially parallel longitudinal sides of said substantially C-shaped channel of said clamping means where said frictionally engagable pin of said face plate clamping means is frictionally secured thereto, so that said frictionally engagable pin of said face plate clamping means is fixedly attached to said substantially C-shaped channel of said face plate clamping means with said generally rectangular-shaped gripper plate of said face plate clamping means movable therealong when said pair of thumbscrews of said face plate clamping means are rotated and tightening said pair of thumbscrews of said face plate clamping means further causes said generally rectangular-shaped gripper plate of said face plate clamping means to move upwardly along said frictionally engagable pin of said face plate clamping means and further secures said helmet rigid flashlight bracket to the portion of the brim of the helmet.

20. A method of using a helmet rigid flashlight bracket being replaceably and securingly attachable to a portion of a brim of a helmet being wearable by a user and replaceably and securingly receiving a flashlight of a variety of different flashlights each of which having a handle portion and a light emitting portion emitting a light beam pointing substantially at eye level in the forward direction of the user, comprising the step of:

a) loosening a threaded set screw of an elongated, slightly arcuate-shaped, and narrow portion of an elongated and substantially L-shaped forwardmost retainer of said helmet rigid flashlight bracket and a threaded set screw of an elongated, slightly arcuate-shaped, and narrow portion of an elongated and substantially L-shaped rearwardmost retainer;

b) placing the handle portion of the flashlight of the variety of different flashlights in a flashlight receptacle chamber of said helmet rigid flashlight bracket with the light emitting portion of the flashlight of the variety of different flashlights facing towards said elongated wide portion of said elongated and substantially L-shaped forwardmost retainer;

c) tightening said threaded set screw of said elongated, slightly arcuate-shaped, and narrow portion of said elongated and substantially L-shaped forwardmost retainer and said threaded set screw of said elongated, slightly arcuate-shaped, and narrow portion of said elongated and substantially L-shaped rearwardmost retainer, so that the handle portion of the flashlight of the variety of different flashlights is replaceably secured in said flashlight receptacle chamber;

d) orientating said helmet rigid flashlight bracket with the light emitting portion of the flashlight of the variety of different flashlights facing forward;

e) positioning replaceably said helmet rigid flashlight bracket on the portion of the helmet with a substantially C-shaped channel of face plate clamping means of said helmet rigid flashlight bracket replaceably receiving the portion of the brim of the helmet; and f) tightening a pair of thumbscrews of said face plate clamping means until said helmet rigid flashlight bracket is replaceably secured to the portion of the brim of the helmet.

21. A method of maintaining a light beam emitting by a light emitting portion of a flashlight of a variety of different flashlights facing forward with the light beam emitting from the light emitting portion of the flashlight of the variety of different flashlights being substantially parallel to a portion of a brim of a helmet on which a handle portion of the flashlight of the variety of different flashlights being mounted, comprising the step of attaching the handle portion of the flashlight to the portion of the brim of the helmet by a helmet rigid flashlight bracket which comprises:

a) a face plate having a lower portion, wherein said face plate has a flat and thin and generally rectangular-shaped upper portion with flat interior surface that has a longitudinal center a flat exterior surface that is substantially parallel to said flat interior surface of said flat, thin and generally rectangular-shaped upper portion of said face plate, a straight top edge with ends, an imaginary bottom line that has ends and is disposed below, and substantially parallel to, said straight top edge of said flat, thin and generally rectangular-shaped upper portion of said face plate, and a pair of opposing, substantially parallel, and straight long sides that extend from said ends of said straight top edge of said flat, thin and generally rectangular-shaped upper portion of said face plate to said ends of said imaginary bottom line of said flat, thin and generally rectangular-shaped upper portion of said face plate;

b) flashlight maintaining means being disposed on said face plate for replaceably and securingly maintaining the handle portion of the flashlight of the variety of different flashlights to said face plate;

c) a substantially C-shaped channel being disposed on said lower portion of said face plate in an orientation so as to be parallel to the light beam emitting from the light emitting portion of the flashlight of the variety of different flashlights; and d) face plate clamping means associated with said substantially C-shaped channel for replaceably and securingly clamping said face plate to the portion of the brim of the helmet, so that the light beam emitting from the light emitting portion of the flashlight of the variety of different flashlights points substantially at eye level in the forward direction of the user;

b) flashlight maintaining means being disposed on said face plate for replaceably and securingly maintaining the handle portion of the flashlight of the variety of different flashlights to said face plate;

c) a substantially C-shaped channel being disposed on said lower portion of said face plate in an orientation so as to be parallel to the light beam emitting from the light emitting portion of the flashlight of the variety of different flashlights; and d) face plate clamping means associated with said substantially C-shaped channel for replaceably and securingly clamping said face plate to the portion of the brim of the helmet, so that the light beam emitting from the light emitting portion of the flashlight of the variety of different flashlights points substantially at eye level in the forward direction of the user.

* * * * *